United States Patent [19]

Stahlecker

[11] Patent Number: 5,038,554

[45] Date of Patent: Aug. 13, 1991

[54] HOLDING ARRANGEMENT FOR A SPINNING OR TWISTING SPINDLE

[75] Inventor: Hans Stahlecker, Sussen, Fed. Rep. of Germany

[73] Assignee: Fritz Stahlecker, Fed. Rep. of Germany; a part interest

[21] Appl. No.: 473,163

[22] Filed: Jan. 31, 1990

[30] Foreign Application Priority Data

Feb. 23, 1989 [DE] Fed. Rep. of Germany ..... 3905533

[51] Int. Cl.[5] ..... D01H 7/12

[52] U.S. Cl. ..... 57/135; 384/229; 384/252

[58] Field of Search ..... 57/129, 135, 92, 93, 57/99, 136, 137, 1 R; 384/229, 230, 231, 252

[56] References Cited

U.S. PATENT DOCUMENTS

| | | | |
|---|---|---|---|
| 256,122 | 4/1882 | Carroll | 384/229 |
| 590,379 | 9/1897 | Scheid | 384/229 |
| 1,014,057 | 1/1912 | Gibson | 384/229 |
| 2,609,254 | 9/1952 | Harris | 57/135 X |
| 3,835,634 | 9/1974 | Anderson et al. | 57/130 |
| 4,187,668 | 2/1980 | Olowinski et al. | 57/130 |
| 4,674,272 | 6/1987 | Widmer | 384/231 X |

FOREIGN PATENT DOCUMENTS

| | | |
|---|---|---|
| 0209799 | 1/1987 | European Pat. Off. . |
| 3612577 | 10/1986 | Fed. Rep. of Germany . |

*Primary Examiner*—Joseph J. Hail, III

*Attorney, Agent, or Firm*—Evenson, Wands, Edwards, Lenahan & McKeown

[57] ABSTRACT

In the case of a holding arrangement for a spinning or twisting spindle at a spindle rail, a holder is provided which has a fastening part that can be mounted at the spindle rail and a holding part receiving the spindle bearing housing. In addition, devices are provided for the adjusting of the relative position of the holding part with the spindle bearing housing with respect to the fastening part.

28 Claims, 1 Drawing Sheet

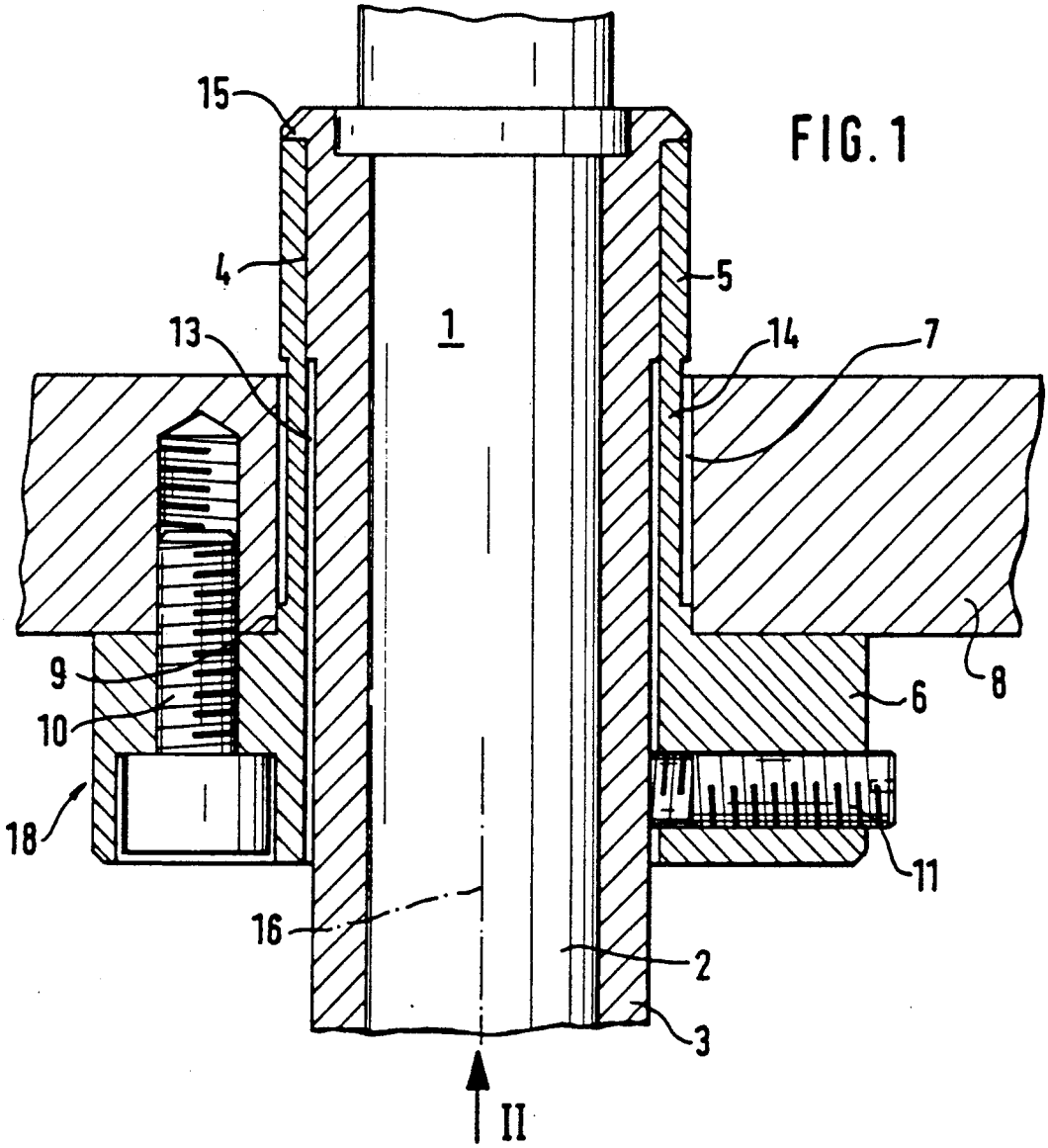
FIG. 1
FIG. 2
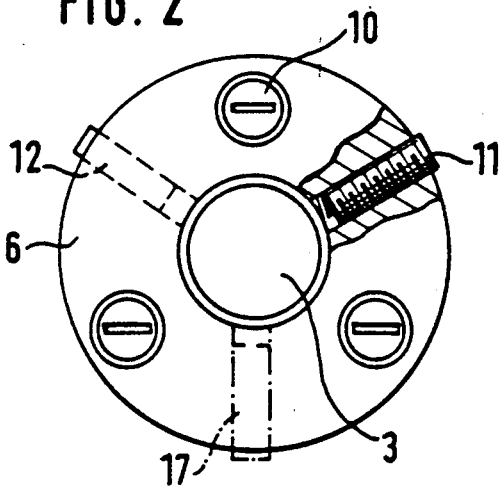
FIG. 3
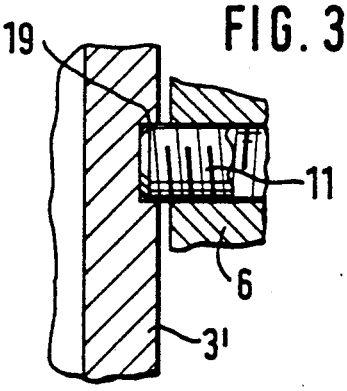

HOLDING ARRANGEMENT FOR A SPINNING OR TWISTING SPINDLE

BACKGROUND AND SUMMARY OF THE INVENTION

The invention relates to a holding arrangement for a spinning or twisting spindle at a spindle rail which is provided with bores for the guiding-through of one spindle bearing housing respectively which, by means of a holder, can be fastened to the spindle rail, the position of the holder being adjustable.

In the case of a known construction of the initially mentioned type (DE-A 36 12 577), the holder consists of a disk-shaped ring in which the spindle bearing housing is held by means of a press fit. The ring is inserted into the bore of the spindle rail by means of a centering projection. A deformable ring-shaped intermediate piece is arranged between the ring and the spindle rail. By means of a more or less strong tightening of the screws which penetrate the spindle rail and pull the holder to the spindle rail, the slope of the spindle bearing housing may be changed while the intermediate piece is deformed so that a setting and an adjustment of the spindle becomes possible with respect to a spinning ring.

It is also known (EP-A 0 209 799) to form the holder from a fastening part which can be fastened to the spindle rail and of a holding part which are arranged at a distance from one another in axial direction and are connected with one another by means of spiral spring elements. In this construction, the whole spring, in radial direction, is to be held elastically flexibly at the spindle rail. An adjusting of the spindle with respect to a ring rail or the like is not provided in this construction.

An object of the invention is to provide a holding arrangement of the initially mentioned type which, on the one hand, permits a secure fastening at the spindle rail and, on the other hand, permits an adjusting of the spinning or twisting spindle with respect to the ring rail or the like that is independent of the fastening.

This object is achieved according to preferred embodiments of the invention in that the holding arrangement has a fastening part that can be mounted at the spindle rail and a holding part which accommodates the spindle bearing housing, and in that devices are provided for the adjusting of the relative position of the holding part with the spindle bearing housing with respect to the fastening part.

By means of separating the holding arrangement into a fastening part and into a holding part, defined conditions are created for the fastening as well as for the adjusting.

In a further development of preferred embodiments of the invention, it is provided that the fastening part and the holding part are connected with one another by means of an intermediate piece which can be deformed by means of the devices for the adjusting. This deformable intermediate piece may be constructed in such a manner that it permits a tilting motion of the spindle or also a radial motion for the adjusting.

In a preferred embodiment of the invention, it is provided that the fastening part and the holding part are arranged at an axial distance and are connected with one another by means of the deformable intermediate piece which extends in axial direction. In the case of this embodiment, a tilting motion of the spindle is carried out for the adjustment of the spindle, the tilting shaft being disposed in the area of the intermediate piece. In this case, it is expediently provided that the deformable intermediate piece extends essentially along the thickness of the spindle rail and, in radial direction, maintains a distance from the interior wall of the bore of the spindle rail, on the one side, and a distance to the spindle bearing housing, on the other side. It is also expedient for the fastening part to be arranged essentially below and for the holding part to be arranged essentially above the spindle rail. As a result, a compact construction is achieved in which the tilting shaft, around which the adjustment takes place, is located approximately in the area of the center of the thickness of the spindle rail. In an expedient construction, it is provided further that the fastening part, the holding part and the intermediate piece are a one-piece component. The deformability of the intermediate piece which preferably is to remain in the elastic range, in this case, is achieved by a corresponding choice of the intermediate piece.

In a further development of preferred embodiments of the invention, it is provided that at least one essentially radial adjusting screw which can be applied to the spindle bearing housing is arranged in the fastening part as the device for the adjusting. This adjusting screw or these adjusting screws are applied to the spindle bearing housing which correspondingly is to be dimensioned such that, in the area that is of interest here, it is more rigid than the intermediate piece. In a further development of the invention, it is provided in this case that the adjusting screw or adjusting screws reach into a recess of the spindle bearing housing. The adjusting screw or adjusting screws will then serve also for the absorption of axial forces so that the deformable intermediate piece is largely relieved from the absorption of axial forces.

In a further development of preferred embodiments of the invention, it is provided that the holding part is manufactured with a deviating slope with respect to a theoretical spindle shaft with respect to which the fastening part is manufactured to be coaxially aligned. This intentionally carried out deviation can be designed such that it corresponds to the sum of all possible eccentricities caused by the tolerances. During the mounting, the adjusting devices must then definitely be operated in order to produce a centricity of the spindle. This alignment of the spindle is checked by means of a testing device with respect to the pertaining spinning ring. In the case of alignments in practice, the deviation provided during manufacturing amounts to approximately 0.3 mm for 100 mm of spindle length.

Other objects, advantages and novel features of the present invention will become apparent from the following detailed description of the invention when considered in conjunction with the accompanying drawings.

BRIEF DESCRIPTION OF THE DRAWINGS

FIG. 1 is a vertical sectional view of a spinning or twisting spindle and its holding arrangement at a spindle rail, constructed according to a preferred embodiment of the invention;

FIG. 2 is a reduced view of the holding arrangement according to FIG. 1 taken in the direction of the arrow II; and FIG. 3 is an enlarged sectional schematic view of a spindle holding arrangement similar to FIG. 1 depicting a detail.

DETAILED DESCRIPTION OF THE DRAWING

The only partially shown spindle 1 contains a bearing housing 3 in which a centering pipe 2 is received in which a spindle shaft is disposed which is not shown. By means of a holder 18, the spindle bearing housing 3 is fastened to a spindle rail 8 in such a manner that the spindle 1, by means of an adjusting of its slope, can be centered with respect to a spinning ring which is not shown. The holder 18 has a fastening part 6 constructed as a ring flange which, by means of screws 10 is fastened from below to the spindle rail 8. The fastening part 6 is centered in a bore 7 of the spindle rail 8, by means of a ring collar 9. In addition, the holder 18 has a holding part 5 in which the bearing housing 3 is held by means of a press fit 4. By means of a ring collar 15, the bearing housing 3 supports itself in axial direction at the holding part 5. The holding part 5 has a cylindrical sleeve-type shape and, directly following the spindle rail 8, is located above this spindle rail 8. Between the holding part 5 and the fastening part 6, a cylindrical sleeve-shaped intermediate piece 14 is provided which, because of its wall thickness, is constructed to be relatively bendable. The intermediate piece 14 maintains a radial distance from the interior wall of the bore 7 of the ring rail 8 so that a ring gap exists in this area. In addition, in the area of the intermediate piece 14 and of the fastening part 6, a ring gap 13 exists with respect to the spindle housing 3 offset by means of a step with respect to the press fit 4.

Inside the fastening part 6, three adjusting screws 11, 12, 17 are arranged which are offset with respect to one another at an angle of 120 degrees and which are radially aimed against the spindle bearing housing 3. The two adjusting screws 11, 12 are expediently arranged such that they face the operating side of the spinning machine so that during the mounting they can be reached easily. The adjusting screw 17 is required only in case, during the adjusting, a plastic deformation occurs in the intermediate piece 14 so that an adjustment is possible against this plastic deformation by means of the adjusting screw 17.

As shown in FIG. 3, in the case of a modified embodiment, the adjusting screws 11, 12, 17 or at least one of the adjusting screws may engage in a recess 19 of the bearing housing 3', such as a ring groove, so that the adjusting screw 11 or the adjusting screws 11, 12, 17 may also take over the axial support of the whole spindle 1.

By adjusting the adjusting screws 11, 12 or also 17, the spindle bearing housing 3 can be changed in its position, whereby a (slight) bending is obtained in the area of the intermediate piece 14. In this case, the spindle bearing housing 3 is designed such that no deformation takes place in it as a result of the occurring adjusting forces, but only in the area of the intermediate piece 14. By means of such an adjustment of the slope of the spindle 1, this spindle 1 can be centered with respect to the spinning ring which is not shown, in which case a corresponding gauge is arranged between the upper part of the spindle and the spinning ring.

The holder 18 is manufactured such that the holding part 5 is aligned with respect to the theoretical spindle shaft which is indicated by the dash-dotted line 16. The holding part 5, on the other hand, is manufactured such that it intentionally has a slight slope with respect to this theoretical spindle shaft 16. This deviation or slope is selected in such a manner that it amounts to 0.3 mm for 100 mm of spindle length. This deviation takes into account the theoretically possible tolerances. Therefore a centering by the operating of the adjusting screws 11 or 12 is definitely necessary. Since the tilting shaft, around which the slope of the spindle 1 can be adjusted, is situated at a distance above the adjusting screws 11, 12, 17, an adjustment of the slope in the area of the spinning ring takes place in the opposite direction to the adjusting of the adjusting screws 11, 12, 17; i.e., when the adjusting screws 11, 12, 17 are tightened, the spindle 1 slopes in the upper area against the tightening direction.

Modifications of the shown holder 18 are easily possible by means of which the same result may be achieved according to other preferred embodiments of the invention. For example, it is possible to apply adjusting screws directly to the holding piece 5 which may be arranged in an additional component or also with a slope in the spindle rail. It is also possible to provide a holder composed of several partial elements. For example, it is possible to provide a holder of two concentric rings which are connected with one another by means of adjusting screws. In this case, an adjusting may be carried out without changing the slope of the spindle 1.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A holding arrangement for holding a spinning or twisting spindle bearing housing at a bore extending through a spindle rail, comprising:

a holder including a fastening part for accommodating mounting of the holder at the spindle rail and a spindle bearing housing holding part for receiving the spindle bearing housing in said bore, and adjusting device means for adjusting the relative position of the holding part with respect to the fastening part to thereby adjust the relative orientation of a spiindle bearing in the holding part and the bore through the spindle rail, wherein a deformable intermediate piece connects the fastening part and the holding part to one another, said adjusting device means including means for deforming the intermediate piece, wherein the fastening part and the holding part are arranged at an axial distance from one another and are connected with one another by means of a deformable intermediate piece extending in an axial direction of the bore, and wherein the deformable intermediate piece extends essentially along the thickness of the spindle rail and, in radial direction, maintains a distance to an interior wall of the bore of the spindle rail, on the one hand, and a distance to the spindle bearing housing, on the other hand.

2. A holding arrangement according to claim 1, wherein the fastening part is arranged essentially below and the holding part is arranged essentially above the spindle rail.

3. A holding arrangement according to claim 1, wherein the fastening part, the holding part and the intermediate piece are a one-piece component.

4. A holding arrangement according to claim 1, wherein the adjusting device means include at least one adjusting screw arranged in the fastening part which can be applied essentially radially to a spindle bearing housing disposed in the holding part.

5. A holding device according to claim 4, wherein the at least one adjusting screw engages in a recess of the spindle bearing housing.

6. A holding arrangement according to claim 1, wherein the holding part is manufactured with a predetermined angular inclination with respect to a predetermined theoretical spindle shaft axis through the fastening part, whereby at least some adjustment with deformation of the intermediate piece is provided in each installation.

7. A holding arrangement according to claim 1, wherein the fastening part is centered in the bore of the spindle rail when in an in-use position fastened thereto.

8. A process for holding a spinning or twisting spindle bearing housing at a bore extending through a spindle rail, comprising:

providing a holder including a fastening part for accommodating mounting of the holder at the spindle rail and a spindle bearing housing holding part for receiving the spindle bearing housing in said bore, and adjusting the relative position of the holding part with respect to the fastening part to thereby adjust the relative orientation of a spindle bearing part and the bore through the spindle rail, wherein a deformable intermediate piece is provided for connecting the fastening part and the holding part to one another, said adjusting including deforming the intermediate piece, wherein the fastening part and the holding part are arranged at an axial distance from one another and are connected with one another by means of the deformable intermediate piece extending in an axial direction of the bore, and wherein the deformable intermediate piece extends essentially along the thickness of the spindle rail and, in radial direction, maintains a distance to an interior wall of the bore of the spindle rail, on the one hand, and a distance to the spindle bearing housing, on the other hand, 9. A holding arrangement for holding a spinning or twisting spindle housing of the type accommodating a spindle shaft and bearing therein at a bore extending through a spindle rail, comprising:

a holder including a fastener part for accommodating mounting of the holder at the spindle rail and a spindle bearing holding part for receiving the spindle bearing housing in said bore, a deformable intermediate piece connecting the fastening part and the holding part to one another, an adjusting device means for adjusting the relative position of the holding part with respect to the fastening part by deforming the intermediate piece to thereby adjust the relative angular orientation of the bearing housing in the bore through the spindle rail.

10. A holding arrangement according to claim 9, wherein the fastening part is arranged essentially below the spindle rail and the holding part is arranged essentially above the spindle rail when in an installed position at the spindle rail.

11. A holding arrangement according to claim 10, wherein the fastening part, the holding part and the intermediate piece are a one-piece component.

12. A holding arrangement according to claim 11, wherein the adjusting device means includes at least one adjusting screw arranged in the fastening part which can be applied essentially radially to a spindle bearing housing disposed in the holding part.

13. A holding arrangement according to claim 9, wherein the fastening part, the holding part and the intermediate piece are a one-piece component.

14. A holding arrangement according to claim 9, wherein the adjusting device means include at least one adjusting screw arranged in the fastening part which can be applied essentially radially to a spindle bearing housing disposed in the holding part.

15. A holding arrangement according to claim 14, wherein the fastening part, the holding part and the intermediate piece are a one-piece component.

16. A holding arrangement according to claim 9, wherein the holding part is manufactured with a predetermined angular inclination with respect to a predetermined theoretical spindle shaft axis through the fastening part, whereby at least some adjustment with deformation of the intermediate piece is provided in each installation.

17. A holding arrangement according to claim 9, wherein said intermediate piece is plasticly deformable during adjustment thereof.

18. A holding arrangement according to claim 17, wherein said adjusting device means includes a plurality of adjusting screws disposed around the circumference of the spindle bearing housing.

19. A holding arrangement according to claim 9, wherein said fastening part is engageable with said spindle rail at one side thereof, and said spindle bearing housing holding part is engageable with said spindle bearing housing at an opposite side of the spindle rail.

20. A holding arrangement according to claim 19, wherein said fastening part is detachably attachable directly to the spindle rail by threaded fastening means, and wherein said adjusting device means includes movable adjusting member means supported at the fastening part and engageable with a spindle bearing housing at an axial spacing from the engagement of the bearing housing holding part with the spindle bearing housing.

21. A process for holding a spinning or twisting spindle bearing housing of the type accommodating a spindle shaft and bearing therein at a bore extending through a spindle rail, comprising:

providing a holder including a fastening part for accommodating mounting of the holder at the spindle rail and a spindle bearing housing holding part for receiving the spindle bearing housing in said bore, providing a deformable intermediate piece connecting the fastening part and the holding part to one another, and adjusting the relative position of the holding part with respect tot he fastening part by deforming the intermediate piece to thereby adjust the relative angular orientation of the bearing housing in the bore through the spindle rail.

22. A process according to claim 21, wherein the fastening part and the holding part are arranged at an axial distance from one another and are connected with one another by means of the deformable intermediate piece extending in an axial direction of the bore.

23. A process according to claim 21, wherein the deformable intermediate piece extends essentially along the thickness of the spindle rail and, in radial direction, maintains a distance to an interior wall of the bore of the spindle rail, on the one hand, and a distance to the spindle bearing housing, on the other hand.

24. A process according to claim 21, wherein the adjusting includes applying at least one adjusting screw arranged in the fastening part radially to a spindle bearing housing disposed in the holding part.

25. A process according to claim 21, wherein the holding part is manufactured with a predetermined angular inclination with respect to a predetermined theoretical spindle shaft axis through the fastening part, whereby at least some adjustment with deformation of the intermediate piece is provided in each installation.

26. A process according to claim 25, wherein the fastening part is centered in the bore of the spindle rail when in an in-use position fastened thereto.

27. A process according to claim 21, wherein the fastening part, the holding part, and the intermediate piece are a one-piece component.

28. A process according to claim 27, wherein the adjusting includes applying at least one adjusting screw arranged in the fastening part radially to a spindle bearing housing disposed in the holding part.

* * * * *